US005434035A

United States Patent [19]

Craver et al.

[11] Patent Number: 5,434,035

[45] Date of Patent: Jul. 18, 1995

[54] FIXER ADDITIVES USED IN COMBINATION WITH IRON COMPLEX BASED BLEACHES TO IMPROVE DESILVERING

[75] Inventors: Mary E. Craver, Rochester, N.Y.; Manuel A. Santos-Rosario, Mayaguez, Puerto Rico; Keith H. Stephen, Rochester, N.Y.

[73] Assignee: Eastman Kodak Company, Rochester, N.Y.

[21] Appl. No.: 175,067

[22] Filed: Dec. 29, 1993

[51] Int. Cl.[6] ..... G03C 7/00; G03C 7/42; G03C 7/44

[52] U.S. Cl. ..... 430/398; 204/109; 205/263; 430/400; 430/372; 430/393; 430/430; 430/428; 430/455; 430/461

[58] Field of Search ..... 430/372, 393, 400, 428, 430/429, 430, 455, 461, 463, 491, 492, 398; 204/109; 205/263

[56] References Cited

U.S. PATENT DOCUMENTS

| | | | |
|---|---|---|---|
| 1,954,316 | 4/1934 | Hickman et al. | 204/109 |
| 2,168,181 | 8/1939 | Ulrich et al. | 430/461 |
| 2,735,774 | 2/1956 | Henn | 95/88 |
| 3,352,676 | 11/1967 | Morcher et al. | 430/372 |
| 3,716,362 | 2/1973 | Meier | 96/60 R |
| 3,994,729 | 11/1976 | Shibaoka | 96/61 R |
| 3,997,348 | 12/1976 | Shimamura et al. | 430/372 |
| 4,428,804 | 1/1984 | Rymwid et al. | 205/263 |
| 4,444,873 | 4/1984 | Ishikawa et al. | 430/393 |
| 4,537,856 | 8/1985 | Kurematsu et al. | 430/372 |
| 4,778,746 | 10/1988 | Ishikawa et al. | 430/372 |
| 4,778,748 | 10/1988 | Kuse et al. | 430/428 |
| 4,804,617 | 2/1989 | Nishikawa et al. | 430/393 |
| 4,963,474 | 10/1990 | Fujita et al. | 430/393 |
| 5,149,618 | 9/1992 | Tappe et al. | 430/461 |
| 5,183,727 | 2/1993 | Schmittou et al. | 430/372 |
| 5,194,139 | 3/1993 | Kinase et al. | 205/263 |
| 5,238,791 | 8/1993 | Tappe et al. | 430/461 |

(List continued on next page.)

FOREIGN PATENT DOCUMENTS

| | | | |
|---|---|---|---|
| 0486909 | 11/1991 | European Pat. Off. | 430/455 |
| 0553569 | 8/1993 | European Pat. Off. | 430/400 |

(List continued on next page.)

OTHER PUBLICATIONS

A. C. Cooley, "The Effect of the Chemical Components of Fixer on Electrolytic Silver Recovery", *J. Imaging Technology*, vol. 12, No. 6, Dec. 1986, pp. 316–322.

R. Mina, J. C. Chang, "Electrolytic Silver Recovery from Spent Fixing Solutions—An Electroanalytical Sudy", *Photo. Sci. and Engineering*, vol. 26, No. 5, Sep.-/Oct. 1982, pp. 223–227.

"Recovering Silver from Photographic Materials", Manuel J-10, Eastman Kodak Company, Rochester, N.Y., 1979.

"Silver Plating from Acid Complex Iodide Baths", D. K. Alpern and S. Toporek, *The Electrochemical Society*, Oct. 1938, pp. 203–207.

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

A method of treating a seasoned fixing solution comprising desilvering a fixing solution containing a chelating compound represented by Formula I $$MOOC(CH_2)m(X)p((CH_2)_nCOOM)_q \quad (I)$$

where X is N, or C—OH;
n and m are independently 0, 1, or 2;
if X is N then p is 0 or 1 and q is 1 or 2;
if X is C-OH then p is 0, 1 or 2 and q is 1 or 2; and
M is a cationic counterion; and
further containing a carryover amount of a bleaching agent which is a complex of ferric ion and a tridentate or a tetradentate ligand.

22 Claims, 2 Drawing Sheets

FOREIGN PATENT DOCUMENTS

| | | | |
|---|---|---|---|
| 2361668 | 6/1974 | Germany | 430/393 |
| 2453172 | 6/1975 | Germany | 430/398 |
| 2405819 | 8/1976 | Germany . | |
| 2808095 | 8/1978 | Germany | 430/398 |
| 4127454 | 2/1993 | Germany | 430/400 |
| 4226372 | 2/1994 | Germany . | |
| 45-39445 | 12/1970 | Japan | 205/263 |
| 47-1682 | 1/1972 | Japan | 205/263 |
| 52/137335 | 11/1977 | Japan . | |
| 56/019048 | 2/1981 | Japan . | |
| 57/200040 | 12/1982 | Japan . | |
| 60/239751 | 11/1985 | Japan . | |
| 61/118751 | 6/1986 | Japan . | |
| 1277952 | 12/1986 | Japan | 430/372 |
| 63/046461 | 2/1988 | Japan . | |
| 63/284546 | 11/1988 | Japan . | |
| 3284546 | 11/1988 | Japan | 430/455 |
| 1223457 | 9/1989 | Japan . | |
| 2176744 | 7/1990 | Japan . | |
| 2190854 | 7/1990 | Japan . | |
| 3196140 | 8/1991 | Japan . | |
| 3101728 | 9/1991 | Japan . | |
| 22961 | of 1898 | United Kingdom | 205/263 |
| 0627186 | 10/1978 | U.S.S.R. | 205/263 |
| 0789638 | 12/1980 | U.S.S.R. | 205/263 |

FIXER ADDITIVES USED IN COMBINATION WITH IRON COMPLEX BASED BLEACHES TO IMPROVE DESILVERING

BACKGROUND OF THE INVENTION

This invention relates to the treatment of processing solutions for silver halide photographic elements, and more specifically to the desilvering of fixing solutions.

During processing of color silver halide elements the silver is oxidized to a silver salt by a bleaching agent, most commonly an iron-complex salt of an aminopolycarboxylic acid, such as the ferric ammonium complex salt of ethylenediaminetetraacetic acid. The bleaching step is followed by removal of this silver salt and any unused silver halide by a fixing agent, such as thiosulfate, which renders the silver salts and silver halide soluble.

The use of this silver solvent causes a build-up of silver in the fixing solution. It is desirable to remove the silver from the fixing solution both for environmental reasons and to recover the silver. There are many methods for desilvering fixing solutions. Electrolytic desilvering is one of the most common because it is simple and it allows recovery of the silver in a very pure form, thus negating the need to send the silver to a refinery.

Traditionally a wash step has been needed between the bleaching and fixing process steps in order to achieve efficient electrolytic desilvering. This is because the removal of silver from silver containing processing solutions is made more difficult when the level of iron increases due to carryover from a preceding solution; see Cooley, Austin C., *The Effect of the Chemical Components of Fixer on Silver Recovery*, Journal of Imaging Technology, Vol 12, Number 6, December 1986 and Mina, R. and Chang, J. C., *Electrolytic Silver Recovery from Spent Fixing Solutions—An Electrochemical Study*, Photographic Science and Engineering, Vol 26, Number 5, September/October 1982. While the wash step minimizes the iron carried into the fixer, thus allowing for easier desilvering of the fixer, it also forces the film or paper processer to incorporate an extra processing step.

An additional problem with desilvering a fixing solution is the need for pH adjustment. Typically the pH of a fixing solution is raised in order to more efficiently desilver. This means that the pH is adjusted, off-line desilvering is carried out, and the pH is readjusted in order to re-use the solution. Such a method is both inconvenient and time consuming. While the pH adjustment can be achieved by a high pH replenisher, this requires additional engineering.

It is the goal of the industry to reduce both the time it takes to process a silver halide photographic element and the number of steps involved. It is a further goal to simplify the procedure for the disposal and reuse of processing solutions. Therefore, a fixing solution which can be efficiently electrolyticaly desilvered without the need to have an additional washing step after the the bleach is highly desired. Further, it is desired to have a fixing solution which can be reused with a minimal number of treatment steps.

SUMMARY OF THE INVENTION

This invention provides a method of treating a seasoned fixing solution comprising desilvering a fixing solution containing a chelating compound represented by Formula I $$MOOC(CH_2)_m(X)_p((CH_2)_nCOOM)_q \quad (I)$$

where X is N, or C—OH;
n and m are independently 0, 1, or 2;
if X is N, then p is 0 or 1 and q is 1 or 2;
if X is C—OH then p is 0, 1 or 2 and q is 1 or 2; and
M is a cationic counter ion;
and further containing a carryover amount of a bleaching agent which is a complex of ferric ion and a tridentate or a tetradentate ligand.

This invention provides a more efficient process for electrolytically removing silver from fixing solutions, especially when such fixers have a relatively high iron concentration due to carryover from a preceding processing solution. Desilvering of fixers that are preceded by a bleach containing a weak iron complex, i.e. those having a ferric complex of a tridentate and tetradentate ligand, proceeds much more efficiently when the fixing solution contains the chelating compounds of this invention. These same fixer additives, in combination with bleaches containing ferric complexes of hexadentate ligands, do not improve electrolytic desilvering speed.

Further, there is no need to adjust pH in order to desilver the fixing solutions of this invention. This can save processing operators time and allows higher solution regeneration rates. This invention allows for more efficient desilvering regardless of whether a system is on-line or off-line Perhaps more importantly, this invention may allow a photofinisher to go to in-line desilvering without adding a washing step to his processor.

FIGURES

Detailed Description

Figure 1:
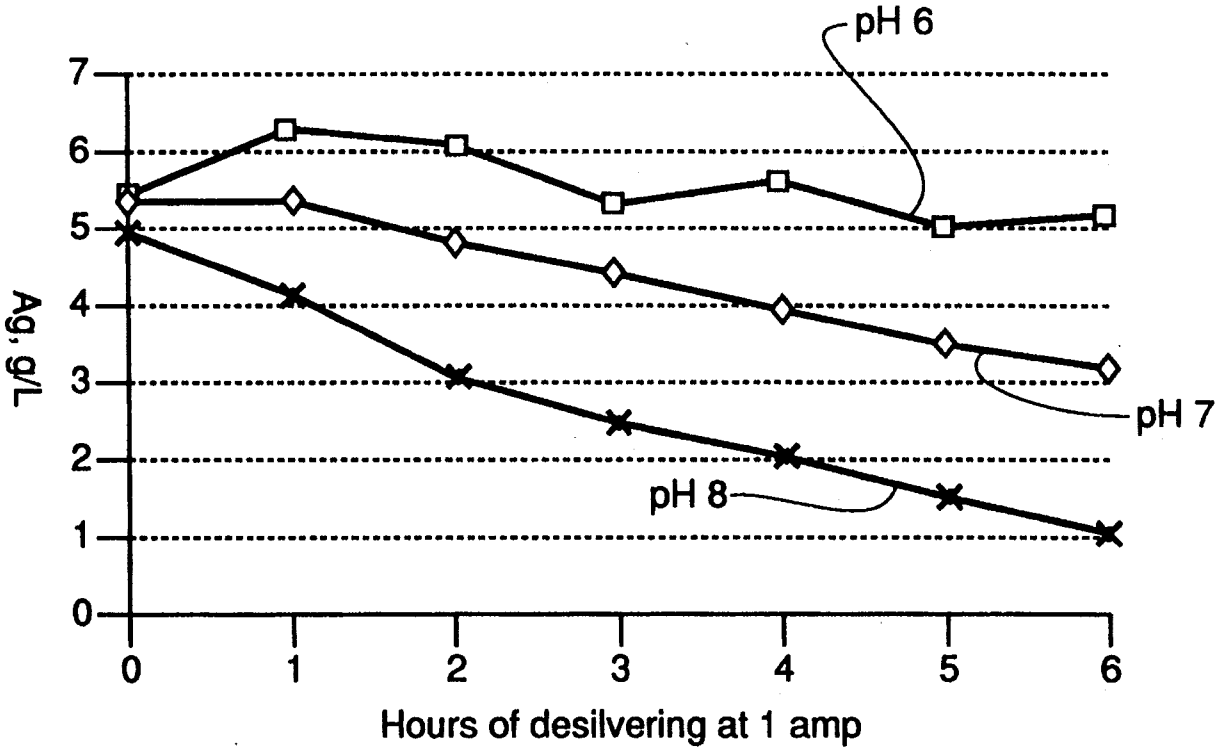
FIG. 1 depicts the effect of pH on the rate of desilvering fixing solutions containing a ferric ethylenediaminetetraacetic acid (EDTA) bleaching agent and citric acid.

The chelating compounds of this invention are represented by Formula I.

$$MOOC(CH_2)_m(X)_p((CH_2)_nCOOM)_q \quad (I)$$

where X is N, or C—OH;
n and m are independently 0, 1, or 2;
if X is N, then p is 0 or 1 and q is 1 or 2;
if X is C—OH then p is 0, 1 or 2 and q is 1 or 2; and
M is a cationic counterion.

Both X and the alkylene groups may be substituted or unsubstituted, so long as the substituents are compatible with the photographic processing solution and do not complex with iron. The more preferred chelating compounds are the hydroxy carboxylic acids and their salts where X is C—OH and q is 2. M is preferably an H, or an alkali metal or ammonium ion. Particularly preferred are those chelating agents which are biodegradable.

The most preferred chelating compounds are citric acid, tartaric acid or malic acid. Examples of other useful chelating agents include β-alaninediacetic acid, nitrilotriacetic acid, glycine, methyliminodiacetic acid and iminodiacetic acid.

The chelating compounds are water soluble and may be added directly to the fixing solution. The effect is best if there is at least an equimolar amount of the chelating compound to the amount of iron carried in from the preceding solution. The amount of iron carried over will depend on many variables such as the amount of iron in the bleach, the processing equipment being used, other sequestrants in the bleach and the type of photographic element.

The preceding solution may be a bleach-fix, a bleach or even a fixer, if the fixing solution is a fix wash from which silver must be removed. A carryover amount of a bleaching agent is that amount of bleaching agent which is carried into the fixing solution from the preceeding solution by the photographic element. As the amount of iron in the fixing solution increases it has more impact on the efficiency of desilvering. Generally, at less than 1 gram of iron per liter of fixing solution, the efficiency gain in desilvering resulting from adding the chelating compounds of this invention is minimal. Carryover may result in the fixing solution containing the bleaching agent in a concentration of up to 80% of the amount of the bleaching agent in the preceding solution, although a concentration of 5% to 40% is more typical. The concentration will depend on the amount of bleaching agent carried over and the replenishment rate of the fixing solution.

Examples of fixing agents which may be used in this invention are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6 -dithia-1,8-octanediole); and a thiourea. These fixing agents can be used singly or in combination. Thiosulfate is preferably used in the present invention. In the most preferred embodiment the fixing solution contains substantially no ammonium ion. That is, the only ammonium ion present is that which is carried in by the photographic element.

The concentration of the fixing agent per liter is preferably about 0.2 to 2.0 mol. The pH range of the fixing solution is preferably 3 to 10 and more preferably 5 to 9. In order to adjust the pH of the fixing solution hydrochloric acid, sulfuric acid, nitric acid, acetic acid, bicarbonate, ammonia, potassium hydroxide, sodium hydroxide, sodium carbonate, potassium carbonate and other acids and bases may be added.

The fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The bleaching agent which is carried over into the fixing solution by the photographic element must contain a complex of ferric ion and a tridentate or tetradentate ligand. The bleaching agent originates in a bleaching solution which is either a bleach bath or a bleach-fix bath. The preferred ligands in the bleaching solution are ionized aminopolycarboxylic acids, although other ligands which form ferric ion salt complexes having bleaching ability and which meet the complexation requirements of this invention may be used. Such ligands might include dipicolinic acid or ligands having $PO_3H_2$ groups. The tridentate aminopolycarboxylic acids which may be used are those which have only three binding sites to the ferric ion, that is they have no additional substituents which might bind to the ferric ion. Further, they must be water soluble, form ferric complexes which have bleaching ability and be compatible with silver halide bleaching systems. The tetradentate aminopolycarboxylic acids which may be used must meet the same criteria except they must contain only four binding sites. Preferably the aminopolycarboxylic acids are biodegradable.

More preferred are tridentate ligands represented by Formula (II) and tetradentate ligands represented by Formula (III) below:

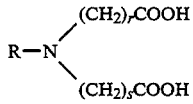

(II)

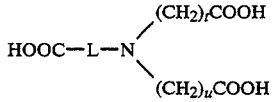

(III)

R represents H, or a substituted or unsubstituted alkyl group, aryl group, arylalkyl group or heterocyclic group. Preferably R is an alkyl group and more preferably it contains 1 to 3 carbon atoms. The letters r, s, t and u are independently 1, 2, or 3. More preferably r and s are 1 and t and u are 1 or 2. The substituents on R can be any group which does not

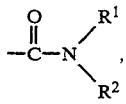

bind to ferric ion, examples of which are, $—OR^3$, $—SR^4$, where $R^1$ through $R^4$ represent an alkyl group or hydrogen atom. The linking group, L, may be any group which does not bind ferric ion and which does not cause the compound to be water insoluble. Preferably L is a substituted or unsubstituted alkylene group, arylene group, arylalkylene group or heterocyclic group and more preferably L is an alkylene chain of one to three carbon atoms which may also be substituted with other non-complexing groups such as a methyl or aryl group.

Representative examples of tridentate ligands which can be described by formula (II) are listed below, but the compounds are not limited by these examples.

List I

1. 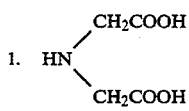

2. 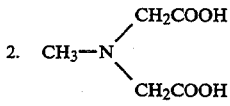

-continued

List I

3. $C_2H_5-N(CH_2COOH)_2$

4. $HOC_2H_4-N(CH_2COOH)_2$

5. $H_2N\overset{O}{\overset{\|}{C}}CH_2-N(CH_2COOH)_2$

6. $CH_3SC_2H_4N(CH_2COOH)_2$

7. $HN(C_2H_4COOH)_2$

8. $CH_3-N(C_2H_4COOH)_2$

9. $(CH_3)_2N\overset{O}{\overset{\|}{C}}CH_2-N(CH_2COOH)_2$

Representative examples of tetradentate compounds which can be described by formula (III) are listed below but the compounds are not limited by these examples.

List II

1. $HOOCCH_2-N(CH_2COOH)_2$

2. $HOOCC_2H_4-N(CH_2COOH)_2$

3. $HOOC\overset{CH_3}{\overset{|}{C}}H-N(CH_2COOH)_2$

4. $HOOC\overset{CH_3}{\overset{|}{\underset{CH_3}{\underset{|}{C}}}}-N(CH_2COOH)_2$

5. $HOOCC_2H_4-N(C_2H_4COOH)_2$

-continued

List II

6. $HOOCCH_2-N(C_2H_4COOH)_2$

The most preferred ligand is methyliminodiacetic acid. Preferred tetradentate ligands are β-alaninediacetic acid and nitrilotriacetic acid.

Many of the tridentate and tetradentate ligands of this invention are commercially available or can be prepared by methods known to those skilled in the art.

Aminopolycarboxylic acid ferric complexes are used in the form of a sodium salt, potassium salt, or ammonium salt. An ammonium salt may be preferred for speed, with alkali salts being preferred for environmental reasons. The content of the salt of an aminopolycarboxylic acid ferric complex in the bleaching solutions of this invention is about 0.05 to 1 mol/liter. The pH range of the bleaching solution is 2.5 to 7, and preferably 4.0 to 7.

The bleaching solution can contain rehalogenating agents such as bromides (e.g., potassium bromide, sodium bromide, and ammonium bromide), chlorides (e.g., potassium chloride, sodium chloride, and ammonium chloride), and iodides (e.g., ammonium iodide). They may also contain one or more inorganic and organic acids or alkali metal or ammonium salts thereof, and have a pH buffer such as boric acid, borax, sodium metaborate, acetic acid, sodium acetate, sodium carbonate, potassium carbonate, phosphorous acid, phosphoric acid, succinic acid, sodium phosphate, citric acid, sodium citrate, and tartaric acid, or corrosion inhibitors such as ammonium nitrate and guanidine. The bleaching solution may also contain bleach accelerators, brighteners or other additives.

The fixing solutions of this invention are desilvered using electrolytic methods. In the electrolytic method of silver recovery, silver is removed from the fixing bath by passing a controlled, direct electrical current between two electrodes (a cathode and an anode), which are suspended in the fixer solution. Silver is deposited on the cathode in the form of nearly pure metallic silver. The cathodes are removed periodically and the plated silver is stripped off. Such methods are well known in the art and are described in detail in such publications as Mina, R. and Chang, J. C., *Electrolytic Silver Recovery form Spent Fixing Solutions—An Elecrochemical Study*, Photographic Science and Engineering, Vol 26, Number 5, September/October 1982; and *Recovering Silver*, Manual J-10, Eastman Kodak Company, Rochester, New York. The desilvering may be done in-line, where the fixing solution is continuously recycled as it is desilvered, or it may be done off-line, where the fixing solution is collected in batches and desilvered.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. The element may also contain a magnetic backing such as described in No. 34390, *Research Disclosure*, Nov. 1992.

In the following discussion of suitable materials for use in the emulsions and elements of this invention, reference will be made to *Research Disclosure*, Dec. 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (110) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of this invention or individual layers thereof can contain among other things brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI) and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamonohydrochloride, 4-N,N-diethyl-2-methylphenylenediaminemonohydrochloride, 4-(N-ethyl-N-2-methanesulfonylaminoethyl)-2-methylphenylenediamine sesquisulfate monohydrate and 4-(N-ethyl-N-2-hydroxethyl)-2-methylphenylenediamine sulfate.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing, or bleach-fixing to remove silver and silver halide, washing and drying. Additional bleaching, fixing and bleach-fixing steps may be utilized.

Typically, a separate pH lowering solution, referred to as a stop bath, is employed to terminate development prior to bleaching. A stabilizer bath is commonly employed for final washing and hardening of the bleached and fixed photographic element prior to drying. A bath can be employed prior to color development, such as a prehardening bath, or the washing step may follow the stabilizing step. Additionally, reversal processes which have the additional steps of black and white development, chemical fogging bath, light re-exposure, and washing before the color development are contemplated. In reversal processing there is often a bath which precedes the bleach which may serve many functions, such as an accelerating bath, a clearing bath or a stabilizing bath. Conventional techniques for processing are illustrated by Research Disclosure, Paragraph XIX.

The following examples are intended to illustrate, without limiting, this invention.

EXAMPLES

EXAMPLES 1

Several "seasoned" fixing solutions were prepared using the fixer formulation shown below with the variations shown in Table I. The iron was added by the addition of the appropriate amounts of Bleaches 1 and 2, as if it were 'carried over' from the previous tank.

| 'Seasoned' fixer formulations: | |
|---|---|
| $(NH_4)_2S_2O_3$ | 74 g |
| Na metabisulfite | 11.2 g |
| Fixer Additive | see Table I |
| Iodide | 75 mg |
| Ag (as AgBr) | approx 7.8 g (4.5 g silver) |
| Fe, | see Table I |
| Bromide, and other bleach constituents | dependent on bleach formulation and amount of iron |
| Water to 1 L | |
| pH | 6.6 |

| Bleach #1(Ferric ethylenediaminetetraacetic acid (EDTA)) | |
|---|---|
| Chemical | Amount |
| water | 800 mLs |
| ferric EDTA complex | 164 grams |
| EDTA salt | 13.5 Grams |
| $KNO_3$ | 31.3 grams |
| bromide salt | 135 grams |
| pH | 5.8 |
| Total Volume | 1 liter |

| Bleach #2 (Ferric methyliminodiacetic acid (MIDA)) | |
|---|---|
| Chemical | Amount |
| water | 850 mLs |
| ferric MIDA complex | 174 grams |
| MIDA salt | 50 Grams |
| $KNO_3$ | 136 grams |
| acidic buffer | 31 mL |
| bromide salt | 42.5 grams |
| pH | 4.25 |
| Total Volume | 1 liter |

The fixing solutions were electrolytically desilvered with an electrolytic cell having the following cell design.

Cell design 2.5 liter plastic cell partially enclosed with a Plexiglas® cover having a headspace volume of 220 mL March 1A-MD-1 pump fitted to cell bottom Stationary cylindrical stainless steel cathode (0.74 $ft^2$)

Hexagonal or cylindrical graphite anode mounted in the center of the cathode (approx. 0.36 $ft^2$)

Ratio of cathode:anode surface area, 2:1

Saturated calomel reference electrode

Sorensen power supply, model XTS 7-6N7 (max. output 7V, 6A)

For comparative purposes, the current in the cell was kept at 1 amp. The cell held approximately 2 liters of solution. The desilvering time shown in Table I is the number of hours needed to reduce silver concentration by one half—from 4.50 to 2.25 g/L

TABLE I

| Iron, g/L | Fixer Containing Ferric EDTA Bleach Desilver time: no citrate | Fixer Containing Ferric EDTA Bleach Desilver time: .05 M citrate | Fixer Containing Ferric MIDA Bleach Desilver time: no citrate | Fixer Containing Ferric MIDA Bleach Desilver time: .05 M citrate |
|---|---|---|---|---|
| 0 | 0.7 | — | 0.7 | — |
| 0.2 | 1.2 | — | 1 | — |
| 0.4 | 1.4 | — | 1.3 | — |
| 1 | 4 | — | 2.7 | — |
| 1.3 | >6.0 | — | 3.9 | — |
| 1.9 | >6.0 | — | 3.9 | — |
| 2.5 | >6.0 | >6.0 | >6.0 | 1.4 |
| 4 | >6.0 | — | >6.0 | — |
| 5 | >6.0 | — | >6.0 | — |

As can be seen from the table, at 2.5 g of iron the combination of the ferric MIDA bleach carryover with citrate in the fixer desilvered at a much higher rate than either ferric EDTA/citrate or Ferric MIDA/without citrate.

EXAMPLE 2

In this example several other chelating compounds were investigated to determine their effect on desilvering rates of fixing solutions containing either ferric MIDA or ferric EDTA bleaching agents. Several "seasoned" fixing solutions were prepared using the fixer formulation shown below with the variations shown in Table II. In this case, all fixing solutions contained 2.5 g/L iron. The iron was added by the addition of the appropriate amounts of Bleaches 1 and 2 described in Example 1.

| 'Seasoned' fixer formulations: | |
|---|---|
| $Na_2S_2O_3$ | 79 g |
| Na metabisulfite | 11.2 g |
| Fixer Additive | .05 M see Table II |
| Iodide | 75 mg |
| Ag (as AgBr) | approx 7.8 g (4.5 g silver) |
| Fe | 2.5 g |
| Bromide, and other bleach constituents | dependent on bleach formulation |
| Water to 1 L | |
| pH | 6.6 |

The fixing solutions were desilvered as described in Example 1. Again the desilvering time shown below is the number of hours needed to reduce the silver concentration from 4.50 to 2.25 g/L.

TABLE II

| Fix Additive 0.05 M | Na Fixer Containing Ferric MIDA Bleach Desilver time | $NH_4$ Fixer Containing Ferric EDTA Bleach Desilver time |
|---|---|---|
| Iminodiacetic acid | 6 | >6.0 |
| Succinic Acid | 4.5 | >6.0 |
| Glycine | 4.4 | >6.0 |
| Hydroxyethylimino diacetic acid | 3.8 | >6.0 |
| Tartaric Acid | 1.2 | >6.0 |
| Citric Acid | 1.3 | >6.0 |

The data in Table II demonstrates that fixing solutions containing combinations of the chelating compounds shown above, most notably hydroxycarboxylic acids, and ferric MIDA bleach desilver more quickly than fixing solutions containing combinations of these same chelating agents with ferric EDTA bleach.

EXAMPLE 3

In this experiment the bleaching agents nitrilotriacetic acid and β-alaninediacetic acid were assessed to determine their effect on the desilvering rates of fixing solutions containing citric acid. Several "seasoned" fixing solutions were prepared using the fixer formulation shown below with the variations shown in Table III. In this case, all fixing solutions contained 2.5 g/L iron. The iron was added by the addition of the appropriate amounts of Bleaches 3 and 4.

| 'Seasoned' fixer formulations: | |
|---|---|
| $Na_2S_2O_3$ | 79 g |
| Na metabisulfite | 11.2 g |
| Fixer Additive | citric acid 0 or 0.05 M |
| Iodide | 75 mg |
| Ag (as AgBr) | approx 7.8 g (4.5 g silver) |
| Fe | 2.5 g |
| Bromide, and other bleach constituents | dependent on bleach formulation |
| Water to 1 L | |
| pH | 6.6 |

| Bleach #3 (Ferric nitrilotriacetic acid (NTA)) | |
|---|---|
| Chemical | Amount |
| water | 800 mLs |
| ferric NTA complex | 128 grams |
| NTA salt | 25 Grams |
| $KNO_3$ | 136 grams |
| acidic buffer | 20 mL |
| bromide salt | 70 grams |
| pH | 4.25 |
| Total Volume | 1 liter |

| Bleach #4 (Ferric β-alanine diacetic acid (ADA)) | |
|---|---|
| Chemical | Amount |
| water | 850 mLs |
| ferric ADA complex | 134 grams |
| ADA salt | 28 Grams |
| acidic buffer | 20 mL |
| bromide salt | 70 grams |
| pH | 4.25 |
| Total Volume | 1 liter |

The fixing solutions were desilvered as described in Example 1. Again the desilvering time shown below is the number of hours needed to reduce the silver concentration from 4.50 to 2.25 g/L,

TABLE III

| Citrate in Fixer | Fixing solution containing Ferric ADA Bleach | Fixing solution containing Ferric NTA Bleach | Fixing solution containing Ferric MIDA Bleach |
|---|---|---|---|
| 0.05 M | 2 | 1.2 | 1.3 |
| none | >6 | 3.1 | 5.6 |

As can be seen from the data in Table III there was an improvement in desilvering rate for all of the fixing solutions.

EXAMPLE 4

Figure 2:
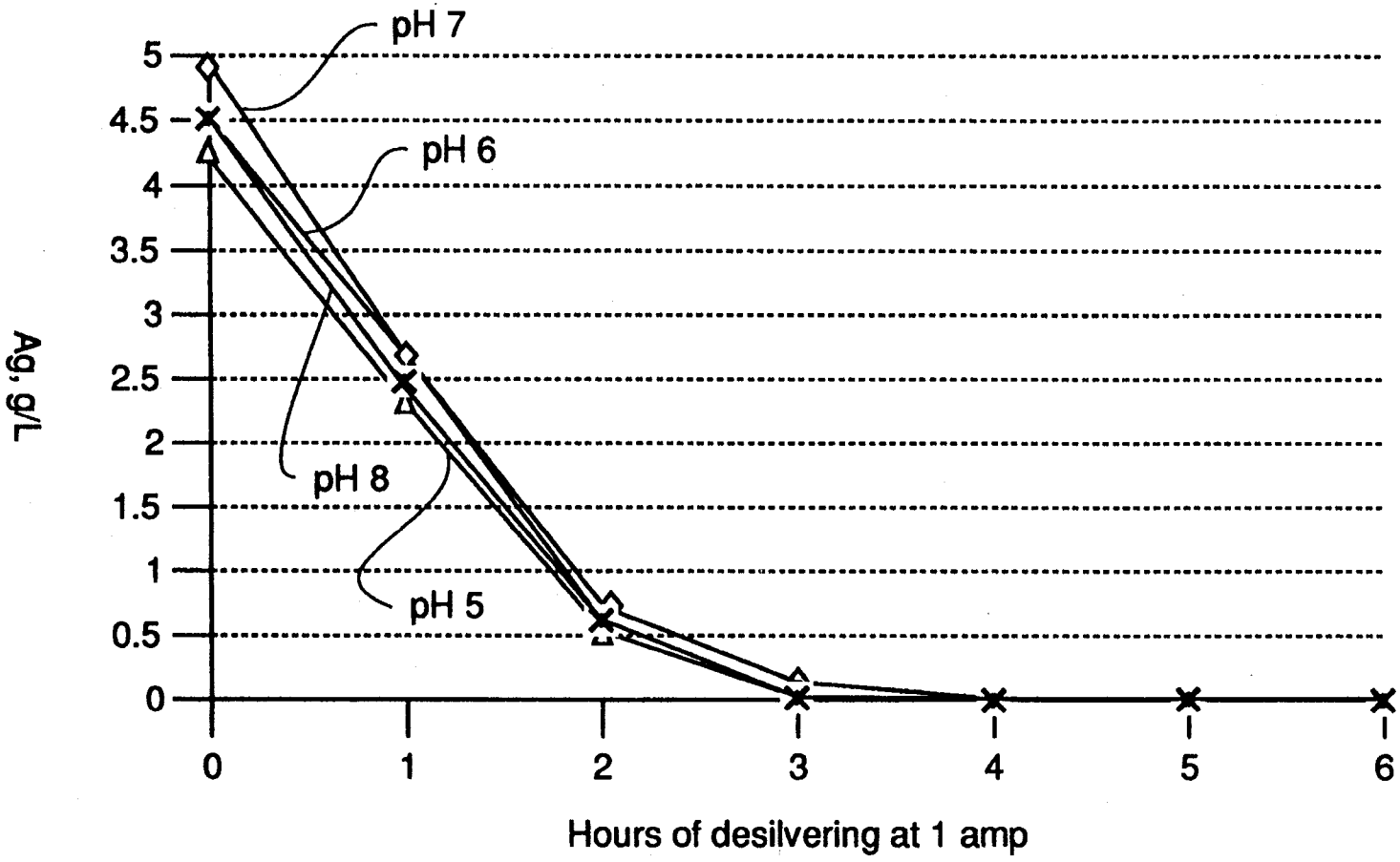
FIG. 2 depicts the effect of pH on the rates of desilvering fixing solutions containing a ferric methyliminodiacetic acid (MIDA) bleaching agent and citric acid.

This example demonstates the effect of pH on the rates of desilvering of fixing solutions containing either ferric MIDA or ferric EDTA bleaching agents and citric acid. Several "seasoned" fixing solutions were prepared using the fixer formulations of Example 2 except that all of the fixing solutions contained 0.05 M citric acid as the chelating compound and the pH of the solutions were adjusted as shown in FIGS. 1 and 2. The fixing solutions were desilvered at described in Example 1.

As can be clearly seen from FIGS. 1 and 2, a change in pH has little effect on the desilvering of the fixing solution containing ferric MIDA bleach, but has a significant effect on the fixing solution containing ferric EDTA bleach. This demonstates that when the chelating compounds of this invention are added to fixing solutions containing ferric complexes of tridentate or tetradentate ligands, the fixing solutions can be desilvered without pH adjustment.

EXAMPLE 5

Several "seasoned" fixing solutions containing ferric MIDA bleach and varying levels of iron were prepared as described in Example 1 except that the fixer formulation contained $Na_2S_2O_3$ instead of or $(NH_4)_2S_2O_3$. The fixing solutions were desilvered as described in Example 1. The results are shown in Table

TABLE IV

| Iron, g/L | Desilver time |
|---|---|
| 0 | — |
| 0.2 | 0.8 |
| 0.4 | 0.8 |
| 1 | 0.8 |
| 1.3 | 1.2 |
| 1.9 | 1.2 |
| 2.5 | 1.3 |
| 4 | 2.9 |
| 5 | >6.0 |

The data in Table IV demonstrates that this invention is also useful for desilvering non-ammonium fixing solutions containing varying levels of iron. In fact, such fixing solutions are preferred as they are more environmentally benign and they desilver somewhat faster than ammonium containing fixing solutions. Other variations such as changes in the amount of thiosulfate or sulfite and pH changes showed no negative effect on the invention.

The invention has been described in detail with particular reference to preferred embodiments thereof, but it will be understood that variations and modifications can be effected within the spirit and scope of the invention.

What is claimed is:

1. A method of treating a seasoned fixing solution comprising desilvering a seasoned fixing solution by electrodeposition, said seasoned fixing solution containing silver and a chelating compound represented by Formula I $$MOOC(CH_2)_m(X)_p((CH_2)_nCOOM)_q \quad (I)$$

where X is N, or C—OH;

n and m are independently 0, 1, or 2;

if X is N then p is 0 or 1 and q is 1 or 2;

if X is C—OH then p is 0, 1 or 2 and q is 1 or 2; and

M is a cationic counter ion; and further containing a carryover amount of a bleaching agent which is a complex of ferric ion and a tridentate or a tetradentate liquid.

2. The method of claim 1 wherein X is C—OH and q is 2.

3. The method of claim 1 wherein the chelating compound is citric acid, malic acid, β-alaninediacetic acid, nitrilotriacetic acid, glycine, methyliminodiacetic acid, iminodiacetic acid, succinic acid, hydroxyethylimino diacetic acid or tartaric acid.

4. The method of claim 1 wherein the molar ratio of the chelating compound to the ferric ion is at least 1:1.

5. The method of claim 1 wherein the ligand is a tridentate or tetradentate deprotonated aminopolycarboxylic acid.

6. The method of claim 1 wherein the bleaching agent is a ferric complex of a tridentate aminopolycarboxylic acid represented by Formula II

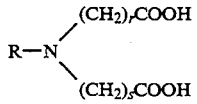

(II)

wherein R is H or an alkyl group; and r and s are independently 1, 2, or 3.

7. The method of claim 1 wherein the bleaching agent is a ferric complex of a tetradentate aminopolycarboxylic acid represented by Formula III

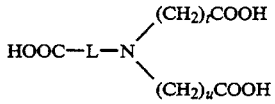

(III)

wherein t and u are independently 1, 2, or 3; and

L is a linking group.

8. The method of claim 6 wherein R is an H or an alkyl group of 1 to 3 carbon atoms and r and s are 1.

9. The method of claim 7 wherein L is an alkylene group of 1 to 3 carbon atoms and t and u are 1 or 2.

10. The method of claim 8 wherein the tridentate ligand is methyliminodiacetic acid.

11. The method of claim 5 wherein the aminopolycarboxylic acid is biodegradeable.

12. The method of claim 1 wherein the fixing solution contains thiosulfate as the fixing agent.

13. The method of claim 11 wherein the fixing solution contains substantially no ammonium ion.

14. The method of claim 5 wherein X is C—OH and q is 2; wherein the tridentate aminopolycarboxylic acid is represented by Formula II

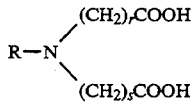

(II)

wherein R is H or an alkyl group; and r and s are 1, 2, or 3 and the tetradentate aminopolycarboxylic acid is represented by Formula III

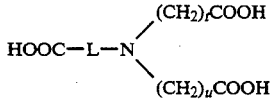

(III)

wherein t and u are 1, 2, or 3; and

L is a liking group; and wherein the molar ratio of the chelating compound to the ferric ion is at least 1:1.

15. The method of claim 14 wherein the bleaching agent is a ferric complex of a tridentate aminopolycarboxylic acid; R is an H or an alkyl group of 1 to 3 carbon atoms; and r and s are 1.

16. The method of claim 14 wherein the bleaching agent is a ferric complex of a tetradentate aminopolycarboxylic acid; L is alkylene group of 1 to 3 carbon atoms; and t and u are 1 or 2.

17. The method of claim 15 wherein the tridentate aminopolycarboxylic acid is methyliminodiacetic acid

18. The method of claim 14 wherein the chelating compound is citric acid, malic acid or tartaric acid.

19. The method of claim 14 wherein the fixing solution contains thiosulfate as the fixing agent.

20. The method of claim 19 wherein the fixing solution contains substantially no ammonium ion.

21. The method of claim 1 wherein the chelating compound is citric acid; the bleaching agent is a ferric complex of methylaminodiacetic acid; the fixing solution contains thiosulfate as the primary fixing agent; and wherein the molar ratio of the chelating compound to the ferric ion is at least 1:1.

22. The method of claim 21 wherein the fixing solution contains substantially no ammonium ion.

* * * * *

UNITED STATES PATENT AND TRADEMARK OFFICE

CERTIFICATE OF CORRECTION

PATENT NO. : 5,434,035
DATED : July 18, 1995
INVENTOR(S) : Mary E. Craver, et al It is certified that error appears in the above-indentified patent and that said Letters Patent is hereby corrected as shown below:

Col. 14, line 20 delete [liking] and insert --linking--

Col. 14, line 41 delete [methylaminodiacetic] and insert --methyliminodiacetic--.

Signed and Sealed this

Twenty-sixth Day of September, 1995

*Attest:*

Bruce Lehman

BRUCE LEHMAN

*Attesting Officer*

*Commissioner of Patents and Trademarks*